United States Patent [19]

Campana

[11] 4,236,972

[45] Dec. 2, 1980

[54] FABRICATED OPENING COVER AND COVER ASSEMBLY

[76] Inventor: Patsie C. Campana, 2614 Sherwood Dr., Lorain, Ohio 44053

[21] Appl. No.: 953,431

[22] Filed: Oct. 23, 1978

[51] Int. Cl.[3] ..... C10B 25/16; C10B 25/20; C10B 25/14

[52] U.S. Cl. ..... 202/242; 202/248; 202/250; 202/251; 202/261; 202/269

[58] Field of Search ..... 202/248, 250, 242, 251, 202/261, 269

[56] References Cited

U.S. PATENT DOCUMENTS

| | | | |
|---|---|---|---|
| 187,768 | 2/1877 | Munzinger | 202/250 |
| 944,005 | 12/1909 | Toogood | 202/250 X |
| 2,920,017 | 1/1960 | Limberg | 202/248 X |
| 3,172,825 | 3/1965 | Maloney | 202/248 |
| 3,486,986 | 12/1969 | Freund | 202/248 |
| 4,115,203 | 9/1978 | Naevestad | 202/248 |
| 4,124,451 | 11/1978 | Dix et al. | 202/248 |

*Primary Examiner*—Barry S. Richman
*Attorney, Agent, or Firm*—Fay & Sharpe

[57] ABSTRACT

A cover and cover assembly fabricated from steel plate for selectively covering an opening communicating with a coke oven and cooperable with seal rim sealing surface which surrounds the opening. The cover includes a knife-like sealing edge which engages the seal rim sealing surface to provide a primary seal therefor. An area on the cover peripheral surface is generally compatible with an area of the seal rim sealing surface for providing a secondary seal. In one instance, the knife-like sealing edge supports the cover in a manner such that compatible sealing rim and cover surfaces are slightly spaced apart from each other. Tar, pitch, residue and by-products of the coking operation which may by-pass the primary seal accummulate in this gap area at the start of a coking operation to complete the secondary seal. In another instance, the compatible seal rim and cover surfaces comprise shoulders which engage each other substantially simultaneous with engagement between the cover sealing edge and seal rim sealing surface. For some applications, an elongated cover handle is affixed to the cover and pivotally mounted to some structure adjacent the sealing rim. The handle also includes spaced apart cover contact means to assist in properly locating the cover in its covering relationship with the opening. At least some of these contact means may be selectively adjustable in order to accommodate any variations in cover alignment.

9 Claims, 5 Drawing Figures

FABRICATED OPENING COVER AND COVER ASSEMBLY

BACKGROUND OF THE INVENTION

This invention relates to a cover or door construction and more particularly to a cover or door construction which is periodically exposed to high temperatures.

The invention is particularly applicable to use in conjunction with coke oven openings and will be described with particular reference thereto. However, it will be appreciated by those skilled in the art that the invention has broader applications and may be used in other environments where a cover or door which is exposed to elevated temperatures must resist or adapt to heat induced warpage which would otherwise prevent proper sealing.

Coke oven is a term of art employed for the large ovens which are used to produce coke or coke by-products from coal. While there are a number of types and styles of coke ovens, they typically have a substantial vertical heighth and depth in relation to the width and, in many respects, resemble a very large closet. Normally, a plurality of the individual ovens are located in a side by side relationship to form what is commonly termed an oven battery in order that a high volume of coke and coke by-products may be made at one location. In many instances, the height of these ovens is well over 10′ and virtually the entire front face thereof may be selectively opened and closed by means of a coke oven door.

In addition to the very large coke oven doors, these ovens also include so-called charging holes and gooseneck openings. These holes or openings are much smaller than the basic coke oven doors with the charging holes being located adjacent the coke oven top and utilized for purposes of charging the coke oven prior to the coking operation. The gooseneck openings are disposed outside the ovens adjacent the bottom areas thereof for purposes of collecting tars, pitch, residue and other by-products of the coking operation. The charging openings typically communicate directly with the associated coke oven whereas the gooseneck openings typically communicate with large tubes or pipes which, in turn, communicate directly with coke ovens. The gooseneck openings are, therefore, in indirect communication with the associated coke oven. During a coking operation, all of the charging and gooseneck openings must be covered or closed in order to prevent any heat and pollution loss from the ovens as well as air admission thereinto.

In prior coke ovens, the charging and/or gooseneck opening covers or doors have been constructed from cast iron and were thought to be the best means in which to avoid undesired warpage during coking operations. Warpage is a significant problem due to high temperatures, e.g., 2000° F. and above, inside the ovens which act on these covers. When warpage occurs, the original close fitting or sealing relationships between the covers and openings is disturbed so that the aforementioned heat and pollution problems occur. Such circumstances are undesirable from both environmental and operational points of view.

While prior charging and gooseneck opening covers have variously utilized special sealing structures, such structures have not eliminated the sealing problems when warpage occurs. The principal problem with prior cast iron covers of this type has been diagnosed as failure to warp evenly when subjected to coking operation temperatures. This problem is magnified for those prior charging and gooseneck opening covers which do not include any special sealing structure. Indeed, in some instances, it was necessary to place refractory brick or material over the cover or door adjacent the edge thereof in order to reduce the emission problem.

The subject invention is directed toward apparatus adapted for use with coke oven charging and gooseneck openings which overcomes the above mentioned problems and others and provides a new and improved cover construction which is simple to manufacture, readily adapted to use on virtually all types of charging and gooseneck openings on different types and styles of coke oven designs, and provides a structure which facilitates continuous sealing around the periphery of an associated charging or gooseneck opening during coking operations.

BRIEF DESCRIPTION OF THE PRESENT INVENTION

In accordance with the present invention, there is provided a fabricated cover or assembly for selectively covering and sealing an opening communicating with a coke oven. The opening includes a rim area therearound and which includes a generally beveled surface tapering inwardly from the outermost end toward the innermost end thereof. The cover is comprised of a cover body fabricated from mild steel to include generally opposed inner and outer faces and a peripheral surface dimensioned to be received and supported by the rim. The peripheral surface has at least a portion thereof beveled generally compatible with the bevel of the beveled rim area surface. A thin sealing edge associated with the cover body extends outwardly of the cover body inner surface peripherally therearound adjacent the outer peripheral edge. This sealing edge is configured to engage the rim area beveled surface to provide a primary seal for the cover.

In accordance with another aspect of the present invention, the sealing edge comprises a knife-like edge removably associated with the cover body and is constructed from high tempered steel.

According to a more specific aspect of the present invention, the sealing edge is dimensioned to engage the beveled rim area surface and support the cover so that the compatible portions of the beveled rim area surface and cover body peripheral surface are slightly spaced apart from each other and define a gap therebetween. This is filled with tar, pitch, residue and other by-products which may by-pass the primary seal at the start of a coking operation to form a secondary cover seal.

According to another more specific aspect of the present invention, the rim area includes a shoulder extending inwardly therefrom into the opening and the cover body includes a shoulder extending outwardly of the peripheral surface. When the cover is placed on the rim area in a covering relationship with the opening and with the cover sealing edge engaging the beveled rim area surface, the two shoulders are placed in a close spaced relationship with each other to provide a secondary cover seal.

In accordance with yet a further aspect of the present invention, a cover handle is provided which is adapted to selectively move the cover between opened and covering positions relative to the opening. The handle includes an elongated body having means at one end thereof to facilitate pivotal mounting at some structure adjacent the opening. The handle also includes contact means for exerting spaced apart contact forces against the cover body to assist in obtaining the desired sealing position for the cover. Moreover, the contact means may be adjustable to accommodate any variations in cover alignment.

The principal object of the present invention is the provision of a fabricated cover and cover assembly which will retain a seal around an associated opening when the cover is exposed to elevated temperatures.

Another object of the present invention is the provision of a fabricated cover and cover assembly which are easy to manufacture from conventional materials.

A still further object of the present invention is the provision of a fabricated cover and cover assembly which have both primary and secondary seal areas with an associated rim area surrounding an opening which communicates with a coke oven.

Other objects and advantages of the present invention will become apparent to those skilled in the art upon a reading and understanding of the following specification.

BRIEF DESCRIPTION OF THE DRAWINGS

The invention may take physical form in certain parts and arrangements of parts, a preferred and alternative embodiments of which will be described in detail in the specification and illustrated in the accompanying drawings which form a part hereof and wherein.

DETAILED DESCRIPTION OF THE PREFERRED AND ALTERNATIVE EMBODIMENTS

Figure 1:
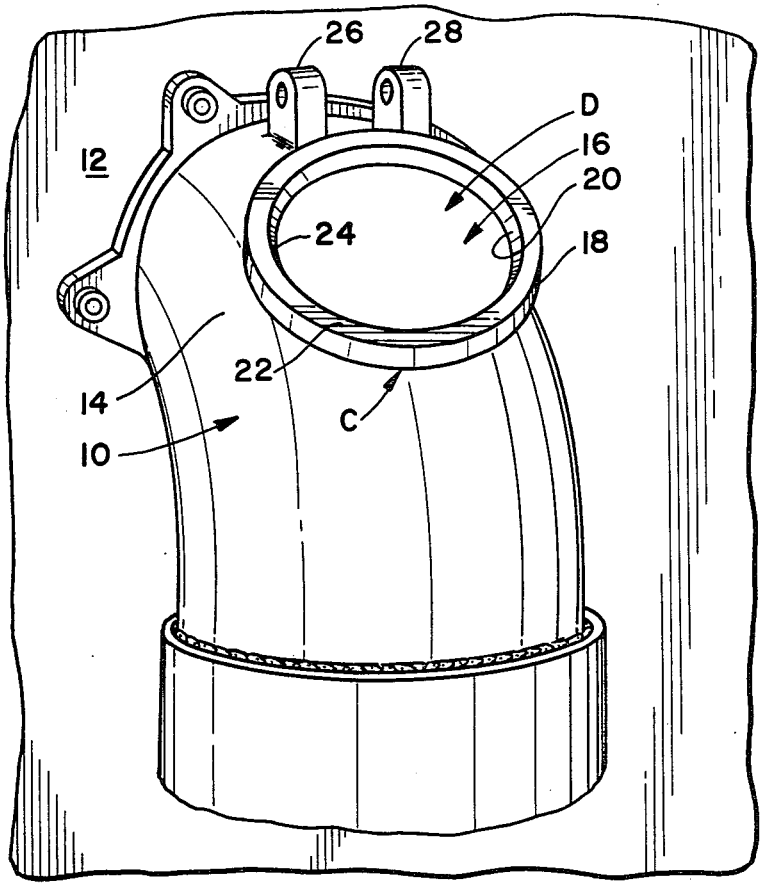
FIG. 1 is a perspective view showing a typical gooseneck opening installation for a coke oven.
Figure 2:
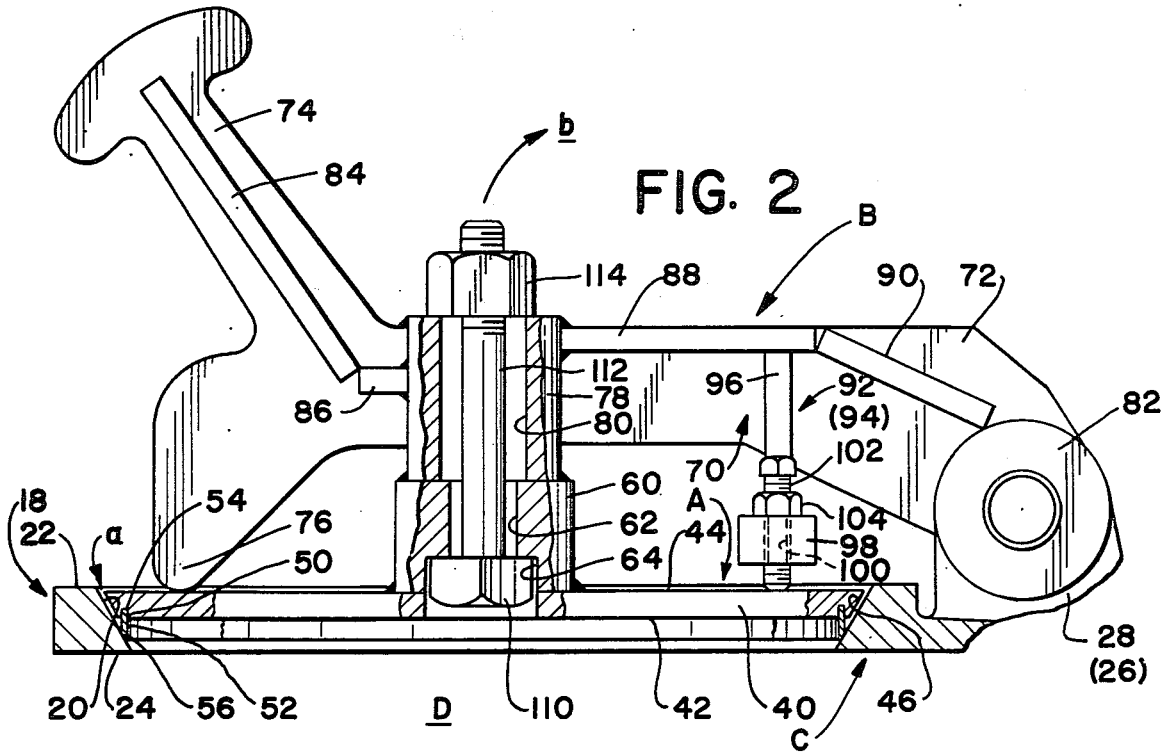
FIG. 2 is a side elevational view in partial cross section showing a cover, handle and seal rim which are formed in accordance with the present invention.

Referring now to the drawings wherein the showings are for purposes of illustrating the preferred and alternative embodiments of the invention only and not for purposes of limiting same, FIGS. 1 and 2 show a cover A having a handle B with the cover engaging a rim C to sealingly cover an opening D.

More particularly, FIG. 1 shows a large so-called gooseneck pipe or tube 10 communicating with the side wall 12 of a coke oven adjacent the lower or bottom area thereof. Typically, a plurality of these pipes or tubes extend outwardly from the associated coke oven and are spaced in a generally side by side relationship therealong. Pipe 10 includes a bend or gooseneck area 14 which, as shown, has a generally circular access opening 16. This access opening allows entry into pipe 10 for purposes of collecting or removing tar, pitch, residue and other by-products which are collected during a coking operation. A rim 18 extends outwardly from pipe 10 a short distance and surrounds opening 16. FIGS. 1 and 2 show this rim as including a surface 20 having at least a portion thereof beveled or tapered from rim outermost area 22 toward rim innermost area 24. A pair of spaced apart door mounting hinges 26,28 extend outwardly from pipe 10 adjacent access opening 16. Although FIG. 1 illustrates a gooseneck type of opening, it will be readily appreciated that the subject inventive concepts are equally applicable to charging openings and the like.

Figure 3:
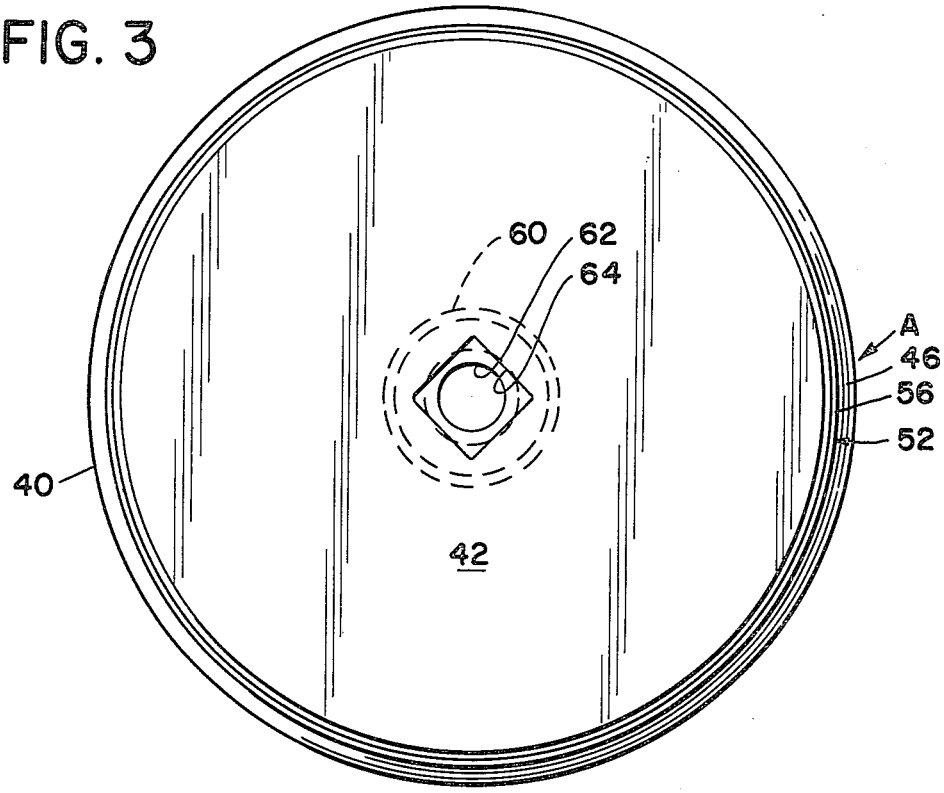
FIG. 3 is a bottom view of the cover of FIG. 2.

Referring more particularly to FIGS. 2 and 3, cover A is comprised of a cover body 40 having a generally circular configuration for accommodating circular access opening 16. In the event this access opening has a geometrical configuration other than circular, cover body 40 would be similarly modified. Body 40 includes opposed generally planar inner and outer surfaces or faces 42, 44, respectively, and an outer peripheral edge surface 46 which extends around the outside of body 40 between the inner and outer surfaces. As will be noted in the drawings, peripheral edge surface 46 is beveled or tapered compatible with sealing surface 20 of rim 18. Although both surfaces 20,46 are shown as being tapered over their entire lateral extent, this configuration may be modified as necessary or desired to accommodate particular cover installations. Cover body 40 is itself constructed from mild steel plate in order to more satisfactorily accommodate heat induced warpage as will become more readily apparent hereinafter.

Extending inwardly into the cover body inner surface 42 adjacent the peripheral edge thereof is a sealing edge receiving groove generally designated 50. This groove extends peripherally around the inner surface and is dimensioned to retainingly receive a knife-like sealing edge generally designated 52 so that the sealing edge is generally normal to the plane of inner surface 42. Sealing edge 52 is constructed from high tempered steel and has opposed end or side edges 54,56 with edge 54 being retainingly received in groove 50. The relative dimensioning of rim 18, cover body 40 and sealing edge 52 are such that they may be located relative to each other in a manner in FIG. 2. That is, end or side edge 56 of sealing edge 52 is received against tapered or beveled surface 20 and supports cover body 40 in a manner such that a gap a is created between surface 20 and the compatibly tapered area of cover body peripheral edge surface 46. This gap acts to define a secondary seal as will be described in some greater detail hereinafter.

A cylindrical mounting block 60 is fixedly mounted as by welding or the like generally centrally of outer surface 44 so as to extend outwardly therefrom. An opening or bore 62 extends through cover body 40 and mounting block 60 and an enlarged counterbore area 64 extends through body 40 from inner surface 42 into mounting block 60. As will be described, this arrangement is used for mounting cover A to handle B.

By way of example, access openings to which the subject invention is particularly directed typically range from approximately 12 to 20″ in diameter. The beveled surfaces 20,46 preferably have an angle of approximately 60° as measured relative to planar inner surface 42 in FIG. 2. Moreover, gap a is preferably in the range of 1/16″ or so with sealing edge 52 having a thickness of approximately 1/16″ and a width as measured between end or side edges 54,56 of approximately ½″. Groove 50 has a width which will retainingly receive the sealing edge but which will also permit selective removal and replacement of that edge when necessary due to wear or the like. For purposes of providing an increased seal between end or side edge 56 of the sealing edge and rim surface 20, and for enhancing its knife-like characteristics, end or side edge 56 may itself be tapered commensurate with the surface 20. The use of high tempered steel for sealing edge 52 allows the edge to cut through tars and the like which accumulate on surface 20 in order to assure a good seal and to absorb extreme abuse as when, for example, the cover is dropped into place.

For purposes of selectively moving cover A between the covering or closed position shown in FIG. 2 and an open position arcuately spaced therefrom in the direction of arrow b, handle B is advantageously employed. This handle is comprised of an elongated handle body 70 having a handle mounting end portion 72, a gripping end portion 74 and a forward, nose-like contact portion 76. Gripping end portion 74 provides a convenient area for gripping the handle for moving it between the open and closed positions and forward contact portion 76 is dimensioned to be in contact with cover body outer surface 44 for reasons which will be described. Handle mounting end portion 72 is constructed from a single piece of mild steel plate with gripping end portion 74 and cover contact portion 76 being similarly constructed from a single piece of mild steel plate so as to have a somewhat V-shaped configuration. These handle components are connected on opposite sides of a cylindrical cover mounting member 78 having an opening 80 extending therethrough substantially coaxial with opening 62 in cover body mounting block 60. A cylindrical handle mounting sleeve 82 is disposed at the terminal end of handle mounting end portion 72 to facilitate pivotally mounting the handle between hinges 26,28. A pin or the like (not shown) may be conveniently inserted through hinges 26,28 and mounting sleeve 82 in a known manner for purposes of completing the handle mounting.

Figure 4:
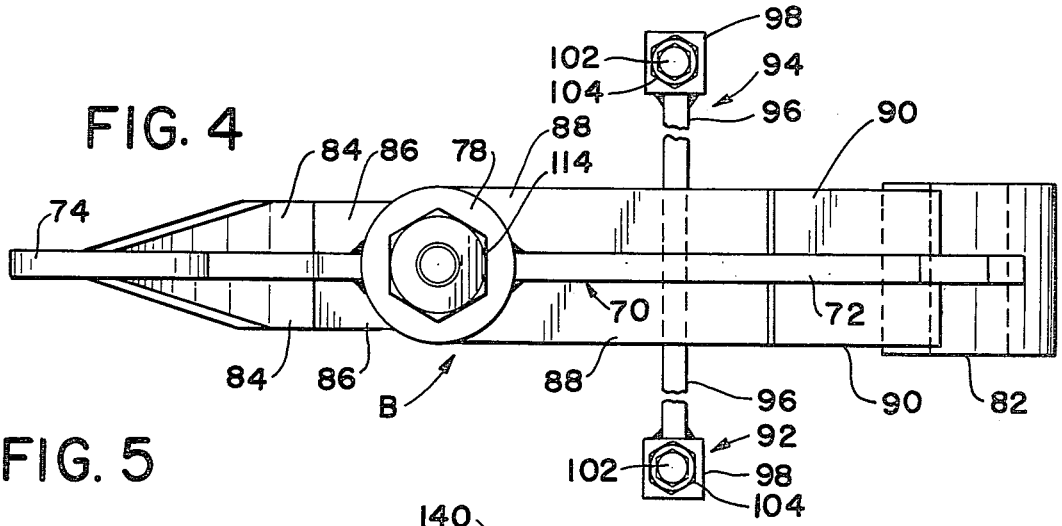
FIG. 4 is a plan view of the cover handle of FIG. 2.

In order to increase the rigidity and strength of elongated handle body 70, a plurality of gussets are advantageously employed. As best shown in FIGS. 2 and 4, a pair of gussets 84 extend from adjacent the outermost end of handle body gripping end portion 74 toward the apex area of that portion with contact portion 76. A set of gussets 86 extend from adjacent this apex area into engagement with cylindrical cover mounting member 78. Another set of gussets 88 extend along handle mounting end portion 72 from cover mounting member 78 and yet another set of gussets 90 extend from the outermost end of gussets 88 toward handle mounting sleeve 82. The gussets of each set or pair 84,86,88 and 90 are oppositely disposed from each other and rigidly affixed to the associated components of elongated handle body 70 by convenient means such as welding or the like.

With continued reference to FIGS. 2 and 4, opposed rear cover contact means 92,94 extend outwardly from handle mounting end portion 72 intermediate cover mounting member 78 and mounting sleeve 82. Each of these contact means includes a plate member generally designated 96 rigidly affixed to mounting end 72 so as to extend generally outwardly thereof in opposed relation to each other. Affixed to the outermost end of plate members 96 are contact member receivers 98 which include a threaded bore 100 extending therethrough. A threaded contact member generally designated 102 is threadedly received in bore 100 and includes a lock nut 104 in operative association therewith. Threaded contact members 102 may be selectively advanced or retracted from their associated contact member receiver 98 in order to increase or decrease the forces they exert against cover body 40. The reasons for this arrangement will be discussed hereinafter in more detail.

As will be noted from FIG. 2, cover A is fixedly secured to handle B by means of an elongated tie bolt having a head 110 received in counterbored area 64. Elongated shank 112 extends from head 110 through mounting block bore 62 of mounting block 60 and cover mounting member opening 80 and threadedly receives a nut 114 at the outermost end thereof.

In using the above described seal rim, cover and handle arrangement, and with the components themselves assembled in a manner shown in FIG. 2, the cover may be selectively moved between the covering or closed position shown and an opened position spaced arcuately therefrom in the direction of arrow b by simply pivoting handle B about its pivot mounting. The forward nose-like contact portion 76 is configured and dimensioned to engage cover body outer surface 44 on one side of mounting block 60 and rear contact means 92,94 are adapted to contact cover body outer surface 44 at spaced apart locations on the other side of mounting block 60 from contact portion 76.

These three contact points or areas provide positive backup for cover body 40 to enhance rigidity therefor and to assist in alignment of the cover with surface 20 of rim 18 when the cover is moved to its covering relationship. In the event some misalignment is present, it may be corrected by advancing or retracting either one or both of threaded contact members 102 of rear contact means 92,94 so as to modify the force applied against the cover body and allow it to flex or be flexed in the necessary manner to overcome such misalignment. In addition, and because the force tending to maintain cover A in its closed position is simply equal to the weight of the cover and handle acting thereagainst, contact 76 and contact means 92,94 assist in distributing the weight of handle B over the entire extent of the cover.

Besides the specific contact portion and means shown in FIGS. 2 and 4 and described hereinabove, some of the possible alternatives are to provide adjustable contact means at forward cover contact portion 76, to provide a pair of spaced apart contact means at the general area of contact portion 76 and to provide a single rear contact means in place of means 92,94. Such modifications will to some extent depend upon the particular installation for which a cover incorporating the concepts of the subject invention is to be employed. Moreover, in some applications, it may be possible to properly align the cover sealing edge with rim surface 20 at the time of cover-handle assembly and installation in order to eliminate the need for any adjustment capabilities for the contact portion and/or contact means.

During a coking operation and with cover A in the closed position as shown in FIG. 2, knife-like sealing edge 52 having side edge 56 thereof in engagement with rim sealing surface 20 provides the primary cover seal for preventing heat and pollution loss outwardly therefrom and to prevent any air admission into the coking oven. Further, since there is a gap a formed between compatible beveled surfaces 20,46 of the rim and cover body, engagement of sealing edge end or side edge 56 with beveled rim surface 20 will facilitate a self centering action for the cover. Such action enhances the desired sealing relationship for the primary seal area. In the event there is any by-pass between sealing edge 52 and rim surface 20 at the start of a coking operation, some of the tars, pitch, residue and other by-products of the coking operation which enter gooseneck pipe or tube 10 will pass into gap a, accummulate at that area and prevent any further by-pass outwardly from the opening. According to standards set by the Environmental Protection Agency (EPA), substantially all coke oven emissions must be stopped within approximately 15 minutes of oven start-up. The embodiment here under discussion provides satisfactory results which meet and are usually better than the prescribed EPA standards.

Use of the knife-like sealing edge 52 in engagement with rim surface 20 for the primary seal and the accummulation of tars, pitch, residue and other by-products in gap a to provide a secondary seal is preferred in this embodiment since there will be heat induced warpage tending to modify the configurations and dimensions of the rim and cover. The detrimental effects of such warpage would be far greater in the event the cover body peripheral edge was required to be closely received against the rim sealing surface to effect sealing. Moreover, fabrication of cover body 40 from mild steel allows the cover to flex with heat induced warpage far better than prior cast iron cover constructions so as to retain the desired sealing relationship between the cover and rim.

Contact portion and means 76,92,94 enhance the retention of sealing engagement between sealing edge 52 and the rim surface and, as previously noted, cover A is substantially self-centering in sealing engagement with rim surface 20. Finally, sealing edge 52 is such that it acts to scrape or otherwise clean tars, pitch, residue and other by-products of the coking operation from rim surface 20 each time the cover is moved from its closed to its opened position and then back to its closed position. This action aids in providing positive sealing engagement between the sealing edge and rim surface.

A slightly modified rim and cover construction which incorporates the same general concepts discussed above is shown in FIG. 5. The structural arrangement of FIG. 5 is typically employed for use in conjunction with a so-called coke oven charging hole although, again, the general structural concepts thereof may be equally applicable to other coke oven openings.

Here, the cover includes a circular cover body plate 140 fabricated from mild steel plate and having opposed generally planar inner and outer surfaces or faces 142,144, respectively. While the cover body is round for purposes of accommodating conventional round charging hole, the inventive concepts involved may be used in conjunction with other hole or opening and cover body configurations. A seal ring 146 having an upper surface 148 is rigidly affixed to body inner surface 142 so as to extend outwardly therefrom peripherally therearound adjacent the outermost edge thereof. Seal ring 146 defines a peripheral surface for the cover body and includes a radially outward projecting shoulder 150 which merges into a tapered or beveled surface 152.

A sealing edge receiving groove 154 extends inwardly into the seal ring at generally the area of merger between shoulder 150 and tapered or beveled surface 152. This groove closely retainingly receives a knife a knife-like sealing edge 156 having opposed inner and outer end or side edges 158,160, respectively. For reasons previously noted, this sealing edge is preferably constructed from high tempered steel in order to resist wear during cover use and/or abuse during cover opening and closing. Since seal ring 146 is separately affixed to cover body plate 140 in this embodiment, a pair of diametral gussets 162,164 are utilized to provide additional cover rigidity.

Figure 5:
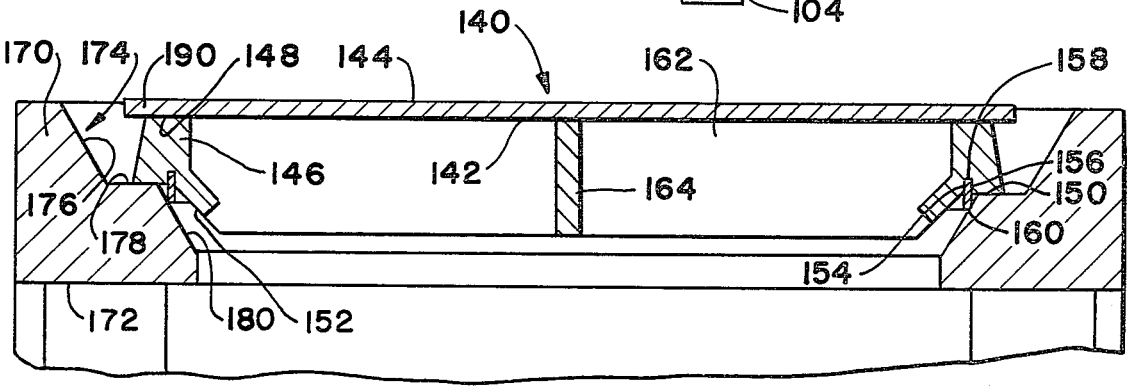
FIG. 5 is a side elevational view in cross section showing a modified cover and seal rim design which incorporates the subject inventive concepts.

In the FIG. 5 arrangement, rim 170 which surrounds the charging hole opening is also fabricated from mild steel plate and includes a bottom surface 172 adapted to be positioned and fixedly mounted relative to some associated coke oven structure. Rim 170 further includes an internal surface area generally designated 174 which surrounds the opening which is to be selectively closed by the cover. This surface is defined by a first tapered or beveled wall 176 tapering inwardly from the outermost area and which merges into a radially inward projecting shoulder 178. This shoulder, in turn, merges into a second inwardly tapered or beveled wall 180 which is slightly different in taper angle from but still compatible with tapered or beveled portion 152 of seal ring 146.

The relative dimensioning between cover body plate 140 with its components and rim 170 with its component surfaces is such that when the cover is in the position shown in FIG. 5, outer end or side edge 160 of sealing edge 156 is placed in sealing engagement with second tapered or beveled wall 180 of the rim. This then forms the primary seal between the cover and rim. In addition, however, shoulders 150,178 are simultaneously placed into engagement with each other so as to form a secondary seal. Thus, the cover is supported on a rim 170 by both sealing edge 156 and shoulder 150. While it would be possible to dimension these components so that the cover is supported solely by sealing edge 156 in the same general manner described above with reference to the embodiment of FIGS. 1–4 to thereby provide a small gap between shoulders 150,178, this embodiment contemplates positive secondary sealing by actual engagement between these shoulders.

The arrangement of FIG. 5 also contemplates opening and closing of the cover without the assistance of a handle of the type described previously with reference to FIGS. 1–4. The cover of FIG. 5 is removed and reinstalled in its covering relationship with the opening in much the same manner as is a conventional manhole. The ledge or shoulder area 190 adjacent the outer peripheral edge area of cover body 140 may be conveniently used for this purpose. Also, a conventional grip or handle (not shown) could be affixed to outer surface 144. Even though no positive cover mounting is provided in the alternative construction, sealing edge 156 will act to center the cover in its cooperative sealing relationship with rim 170.

The subject cover or door may be readily constructed to fit any coke oven charging or gooseneck openings by simply modifying the necessary dimensional characteristics thereof. Moreover, and in many cases where an original cast iron cover is to be replaced by the subject new cover, the original rim configuration may be used. However, in other instances, it is necessary to provide a new rim construction having structural characteristics similar to those described hereinabove.

The invention has been described with reference to the preferred and one alternative embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. In combination with a coke oven, a fabricated cover for selectively sealingly covering an opening communicating with the coke oven; wherein said opening includes a rim area disposed therearound, said rim area defining an opening peripheral surface including an opening beveled surface tapering inwardly from the outermost end toward the innermost end thereof, said cover comprising:

a cover body fabricated from mild steel plate to include generally opposed inner and outer faces, said cover having a cover peripheral surface, an annular thin sealing edge rigidly mounted on said cover so as to extend outwardly therefrom in a direction away from said cover body inner face peripherally therearound adjacent said cover peripheral surface; said cover peripheral surface including a secondary sealing portion spaced from said sealing edge and located outwardly therefrom between said sealing edge and said outer face of said cover body; and when said cover is positioned for closing the coke oven opening, said sealing edge engaging the beveled surface around the opening to support said cover and to form a primary seal, said secondary sealing portion being spaced from said sealing edge outwardly thereof and toward said cover body outer face and positioned in closely spaced parallel relationship to the adjacent portion of the opening peripheral surface to provide an annular channel forming a secondary seal so that tar, pitch, residue and other by-products of a coking operation in said coke oven which may by-pass said primary seal accumulate in said annular channel to form a secondary seal for said cover.

2. The combination as defined in claim 1 wherein said sealing edge comprises an annular band having a knife edge constructed from high tempered steel and is removably, rigidly mounted in said cover body.

3. The combination as defined in claim 1 wherein said annular channel defines a gap that is not greater than approximately 1/16" as defined by the spacing between said secondary sealing portion and opening peripheral surface.

4. The combination as defined in claim 1, wherein said cover body is a flat, mild steel plate; and including means for selectively adjusting the warpage of said plate, comprising three contact means mounted on said plate in a triangular pattern for exerting one of a tension force and a compression force at the mounting location of said steel plate, respectively, connecting means mounted substantially centrally on said plate substantially centrally of said triangular pattern for exerting the other of said tension force and compression force on said steel plate at its mounting point, connecting body means rigidly extending between said connecting means and each of said contact means for force interconnecting and providing the reaction forces opposed to said tension and compression forces, at least two of said contact means providing adjustment for the adjacent spacing between said connecting body means and said plate, said connecting means including power means providing a mechanical advantage for exerting the other force on said plate to change the warpage of said plate in accordance with the spacing adjustments of said contact means, and one of said contact means and connecting means that transmits tension forces being welded to said plate.

5. The combination as defined in claim 1 further including a cover handle adapted to selectively move said cover between opened and covering positions relative to said opening, said handle including: an elongated body having means at one end thereof adapted to pivotally mount said handle to some structure adjacent said opening; connecting means for connecting said handle to said cover body generally centrally of said outer face; and, contact means for exerting contact forces against said outer face at generally opposed areas spaced from said connecting means, whereby said contact means assists in placing said cover body in sealing engagement with said rim area beveled surface when said cover body is in said covering position and in retaining said sealing engagement during a coking operation.

6. The combination as defined in claim 5 wherein said contact means comprises a plurality of individual contact means and wherein at least one of said individual contact means is adjustable toward and away from said cover body relative to said handle body for selectively allowing variations in the contact forces applied to said cover body at said outer face.

7. In combination with a coke oven, a selectively movable closure for an opening communicating with the coke oven having a stationary seal rim fabricated from mild steel which surrounds said opening, said seal rim including a beveled sealing surface tapering inwardly from the outermost end toward the innermost end thereof, said cover comprising:

a movable cover body fabricated from mild steel to include generally opposed parallel inner and outer faces and a peripheral surface having at least a portion thereof beveled generally parallel and coextensive with the bevel of said seal rim sealing surface, and said cover body being dimensioned to be supported by said seal rim; an annular member having a thin sealing edge and being mounted on said cover body and extending outwardly of said over body peripheral surface, said annular member and sealing edge being configured and dimensioned to engage said seal rim beveled sealing surface to provide a primary seal for said cover and for supporting said cover body in a manner such that said seal rim sealing surface and said beveled portion of said cover body peripheral surface are uniformly slightly spaced apart from each other from said sealing edge toward said outer face of said cover body to define an annular, elongated sealing channel in the gap therebetween so that tar, pitch, residue and other by-products of a coking operation in said cover oven which may by-pass said primary seal accumulate in said gap to form a secondary seal for said cover body; and, means for selectively moving said cover between opened and covering positions relative to said opening.

8. The combination as defined in claim 7 wherein said sealing edge comprises an annular band having a knife edge constructed from high tempered steel, said band being removably and rigidly mounted in said cover body.

9. The combination as defined in claim 7, wherein said cover body is a flat, mild steel plate; and including means for selectively adjusting the warpage of said plate, comprising three contact means mounted on said plate in a triangular pattern for exerting one of a tension force and a compression force at the mounting location of said steel plate, respectively, connecting means mounted substantially centrally on said plate substantially centrally of said triangular pattern for exerting the other of said tension force and compression force on said steel plate at its mounting point, connecting body means rigidly extending between said connecting means and each of said contact means for force interconnecting and providing the reaction forces opposed to said tension and compression forces, at least two of said contact means providing adjustment for the adjacent spacing between said connecting body means and said plate, said connecting means including power means providing a mechanical advantage for exerting the other force on said plate to change the warpage of said plate in accordance with the spacing adjustments of said contact means, and one of said contact means and connecting means that transmits tension forces being welded to said plate.

* * * * *